US007922536B2

(12) United States Patent
Zhang et al.

(10) Patent No.: US 7,922,536 B2
(45) Date of Patent: Apr. 12, 2011

(54) CABLE CONNECTOR ASSEMBLY WITH IMPROVED SHIELDING MEMBER

(75) Inventors: Xiao-Kang Zhang, Kunshan (CN); Hou-Yu Shi, Kunshan (CN); David Ko, Fullerton, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/579,425

(22) Filed: Oct. 15, 2009

(65) Prior Publication Data

US 2010/0093218 A1 Apr. 15, 2010

(30) Foreign Application Priority Data

Oct. 15, 2008 (CN) ..... 2008 2 0302424
Nov. 13, 2008 (CN) ..... 2008 2 0302764

(51) Int. Cl.
*H01R 13/648* (2006.01)

(52) U.S. Cl. ..... 439/607.45

(58) Field of Classification Search ..... 439/607.45, 439/607.48, 607.41, 607.52, 682
See application file for complete search history.

(56) References Cited

U.S. PATENT DOCUMENTS

| | | | | |
|---|---|---|---|---|
| 5,425,657 | A * | 6/1995 | Davis et al. | 439/607.52 |
| 5,725,395 | A * | 3/1998 | Lee | 439/607.48 |
| 6,165,016 | A * | 12/2000 | Lai | 439/607.41 |
| 6,390,852 | B1 * | 5/2002 | Wang | 439/607.48 |
| 6,783,397 | B2 * | 8/2004 | Yang Lee | 439/607.45 |
| 2009/0061695 | A1 * | 3/2009 | Ko et al. | 439/682 |
| 2010/0093218 | A1 * | 4/2010 | Zhang et al. | 439/607.45 |

* cited by examiner

*Primary Examiner* — Alexander Gilman
(74) *Attorney, Agent, or Firm* — Wei Te Chung; Andrew C. Cheng; Ming Chieh Chang

(57) ABSTRACT

A cable connector assembly (100) includes an insulative housing (22) having a plurality of contacts received therein, a cable assembly (3) connected with the contacts by a printed circuit board (5), an upper shielding member (11) and a lower shielding member (12) together with the upper shielding member to form a receiving space (10). Each of the upper shielding member and the lower shielding member have a base portion (111, 121) and a plurality of vertical walls (113, 114, 115, 123, 124, 125) extending from the base portion. The lower shielding member (12) defines a stopping portion (126) to prevent the upper shielding member (11) from moving along a transverse direction. The stopping portion (126) is of U-shaped and comprises a first restricting flake (1261) and a second restricting flake (1262), and a corresponding vertical wall (113) of the upper shielding member is located between the first restricting flake (1261) and the second restricting flake (1262).

14 Claims, 8 Drawing Sheets

CABLE CONNECTOR ASSEMBLY WITH IMPROVED SHIELDING MEMBER

BACKGROUND OF THE INVENTION

1. Field of the Invention

This application claims priority to prior Chinese patent applications 200820302424.3 and 200820302764.6, the disclosure of which are incorporated herein by reference.

The present invention generally relates to a cable connector assembly, and more particularly to a cable connector assembly with an improved shielding member.

2. Description of Related Art

An electrical connector is connected with a cable or more cables to form a cable connector assembly, and the connector always connected with the cable by a printed circuit board, contacts of the connector and a connecting portion of the cable are soldered on the printed circuit board, as the printed circuit board is received in a shielding member unsteadily, so the contacts will be unstable on the printed circuit board as the cable be rocky, so that the cable connector assembly can't work normally.

In addition, CN patent No. 101232136A issued to Shen on Jul. 30, 2008 discloses a cable connector assembly, the cable connector assembly comprises an electrical connector for mating with a complementary connector, a fixing member, an insulative cover, a push portion and a cable assembly. The electrical connector includes an insulated housing with a plurality of contacts retained therein, a first shielding member and a second shielding member. The first shielding member comprises a first plate and a second plate, and the first plate has a plurality of collaborating portions extending from lateral sides and a rear end thereof, the collaborating portion on the rear end defines a latch. The second shielding member comprises a horizontal third plate and a side wall vertical to the third plate, the third plate has a plurality of mounting portions cooperating with the corresponding collaborating portions of the first shielding member. However, the combination between the mounting portions and the collaborating portions may be weak to induce the first shielding member to be separated from the second shielding member.

Correspondingly, it is desired to have a cable connector assembly with improved shielding member to address the problems stated above.

BRIEF SUMMARY OF THE INVENTION

Accordingly, an object of the present invention is to provide a cable connector assembly having an improved shielding member to position a printed circuit board and prevent from splitting thereof.

In order to achieve the above-mentioned object, a cable connector assembly in accordance with the present invention comprises an insulative housing having a plurality of contacts received therein, a cable assembly connected with the contacts by a printed circuit board, an upper shielding member and a lower shielding member together with the upper shielding member to form a receiving space. Each of the upper shielding member and the lower shielding member have a base portion and a plurality of vertical walls extending from the base portion. The lower shielding member defines a stopping portion to prevent the upper shielding member from moving along a transverse direction. The stopping portion is of U-shaped and comprises a first restricting flake and a second restricting flake, and a corresponding vertical wall of the upper shielding member is located between the first restricting flake and the second restricting flake.

Other objects, advantages and novel features of the invention will become more apparent from the following detailed description of the present embodiment when taken in conjunction with the accompanying drawings.

DETAILED DESCRIPTION OF THE INVENTION

Figure 1:
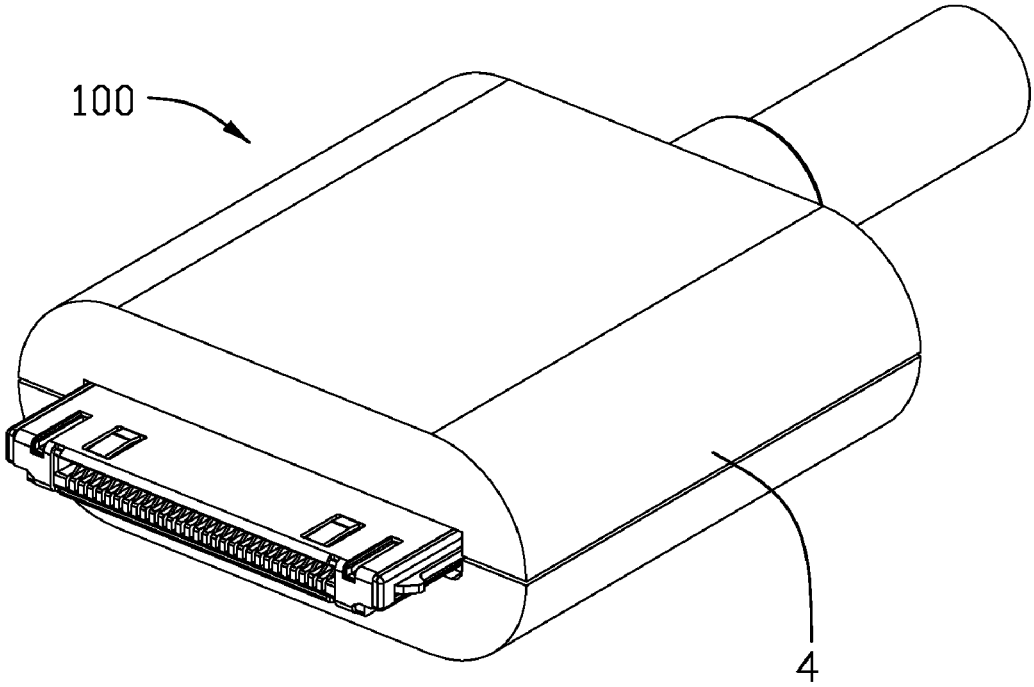
FIG. 1 is an assembled, perspective view of a cable connector assembly.

Reference will now be made to the drawing figures to describe the present invention in detail.

Referring to FIGS. 1-8, a cable connector assembly 100 in accordance with the present invention comprises an upper shielding member 11, a lower shielding member 12 together with the upper shielding member 11 to form a receiving space 10, a connector 2 mating with a complementary connector, a printed circuit board 5 electrically connected with the connector 2 and accommodated in the receiving space 10, an insulated cover 4 and a cable assembly 3. The connector 2 comprises a metallic shell 21 and an insulative housing 22 with a group of first contacts 23 and a group of second contacts 24 retained therein.

Figure 2:
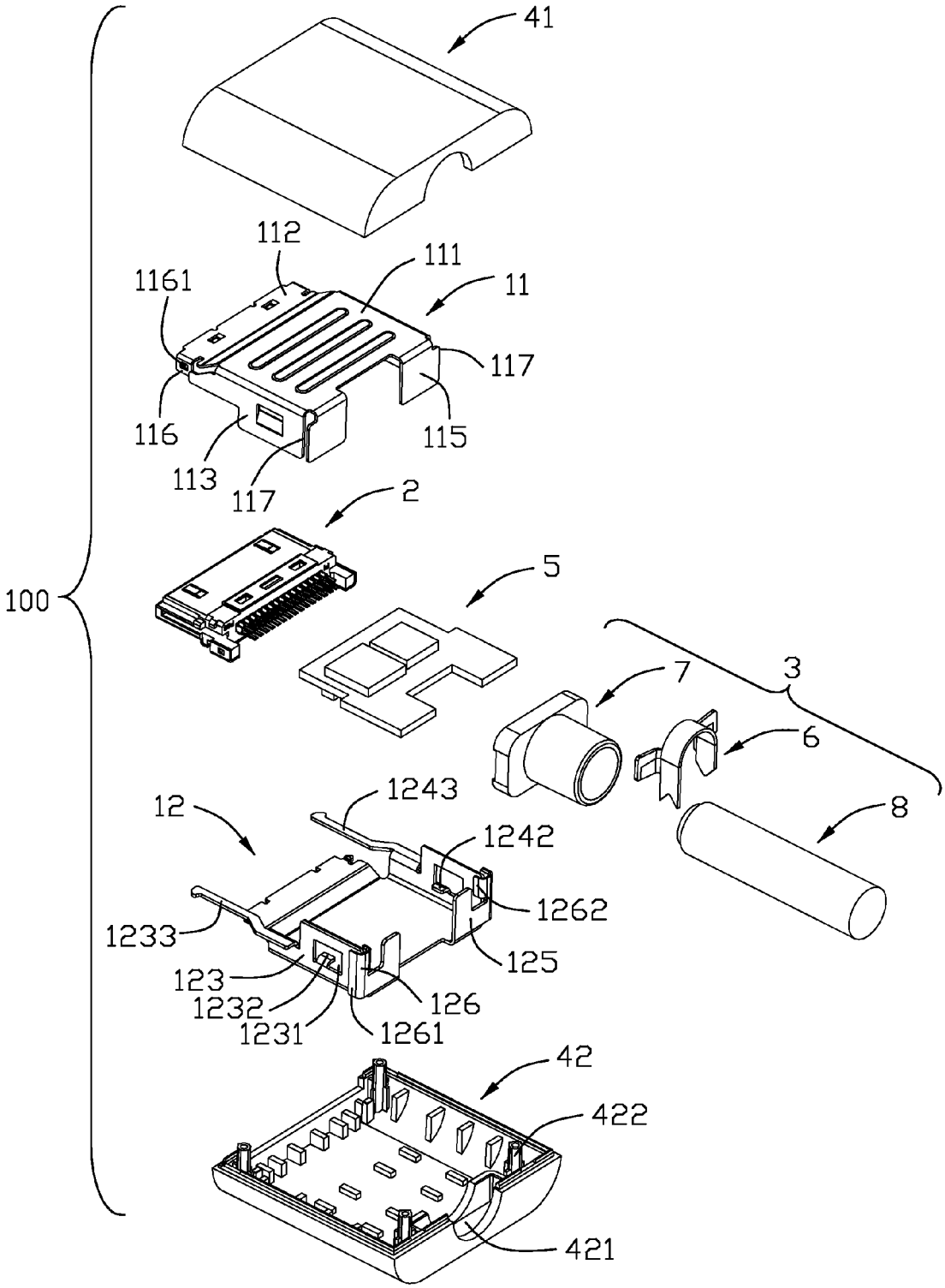
FIG. 2 is an exploded, perspective view of the cable connector assembly shown in FIG. 1.
Figure 3:
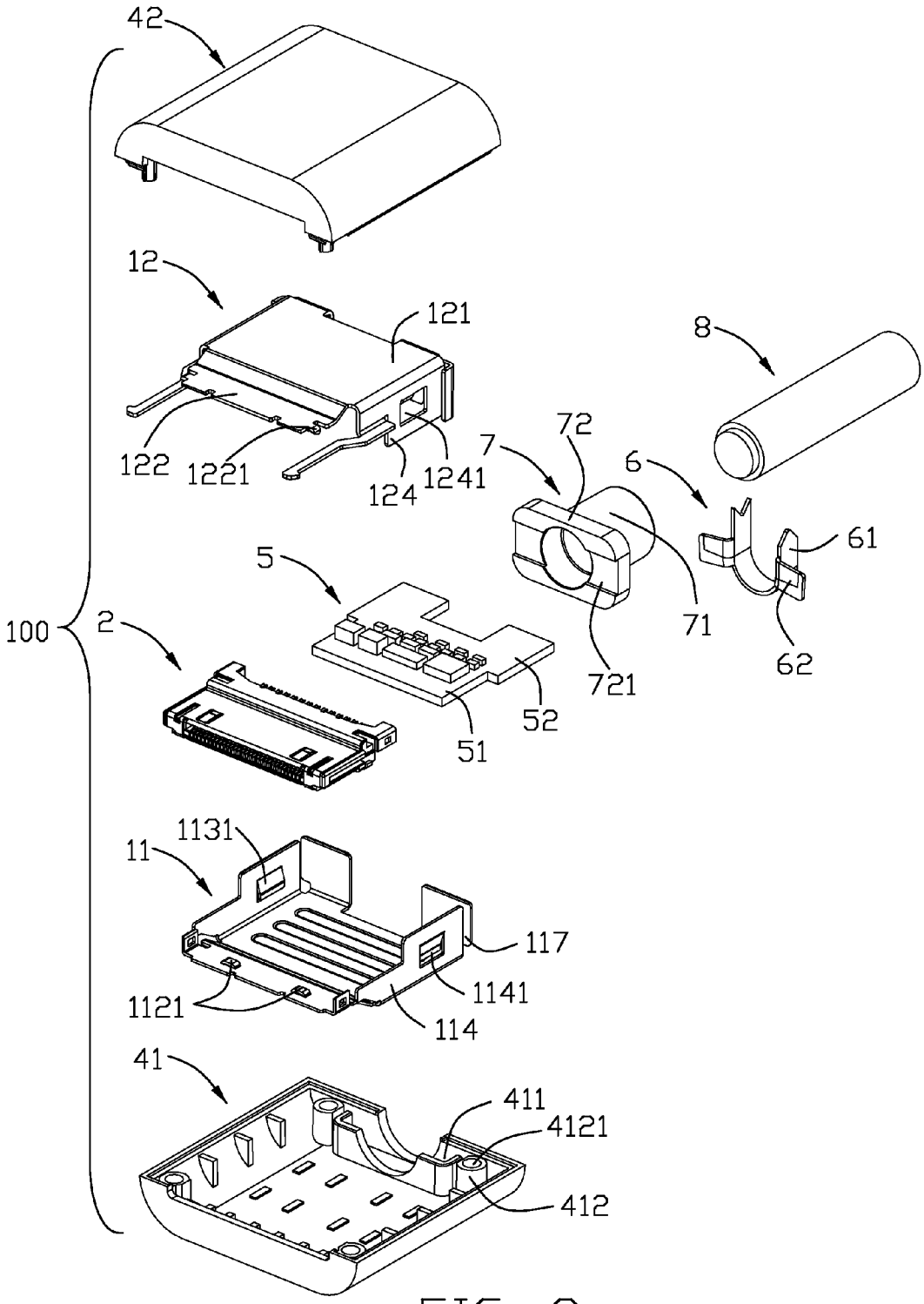
FIG. 3 is similar to FIG. 2, but viewed from another aspect.
Figure 6:
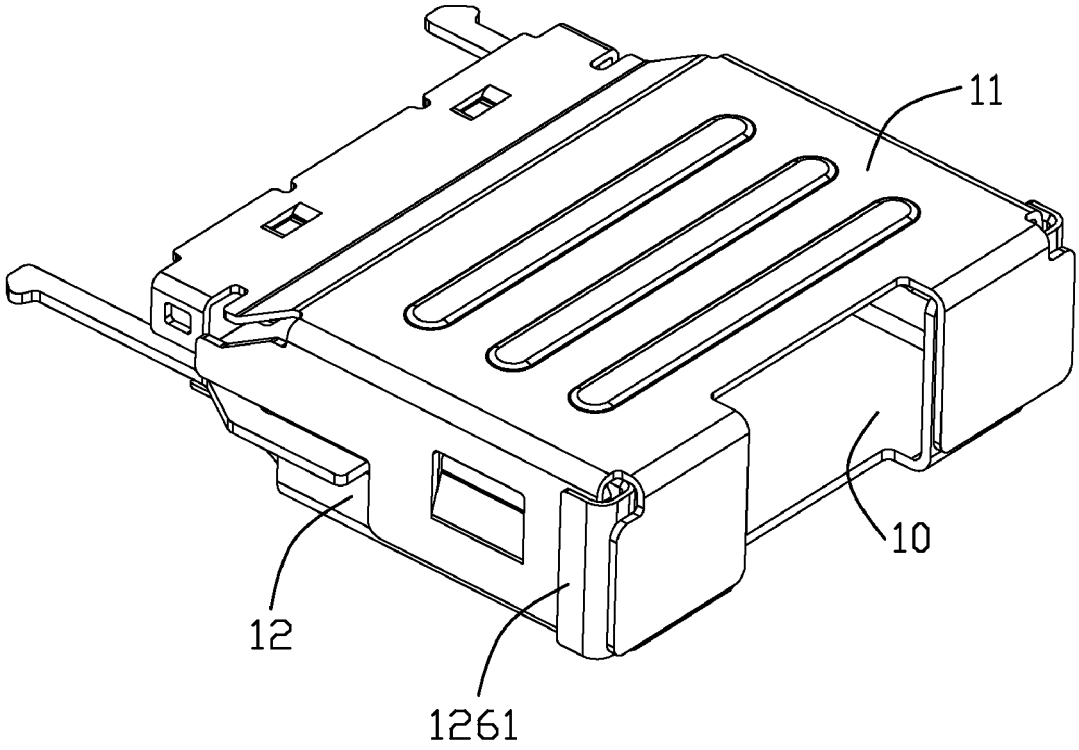
FIG. 6 is an assembled, perspective view of an upper shielding member and a lower shielding member of the cable connector assembly.
Figure 7:
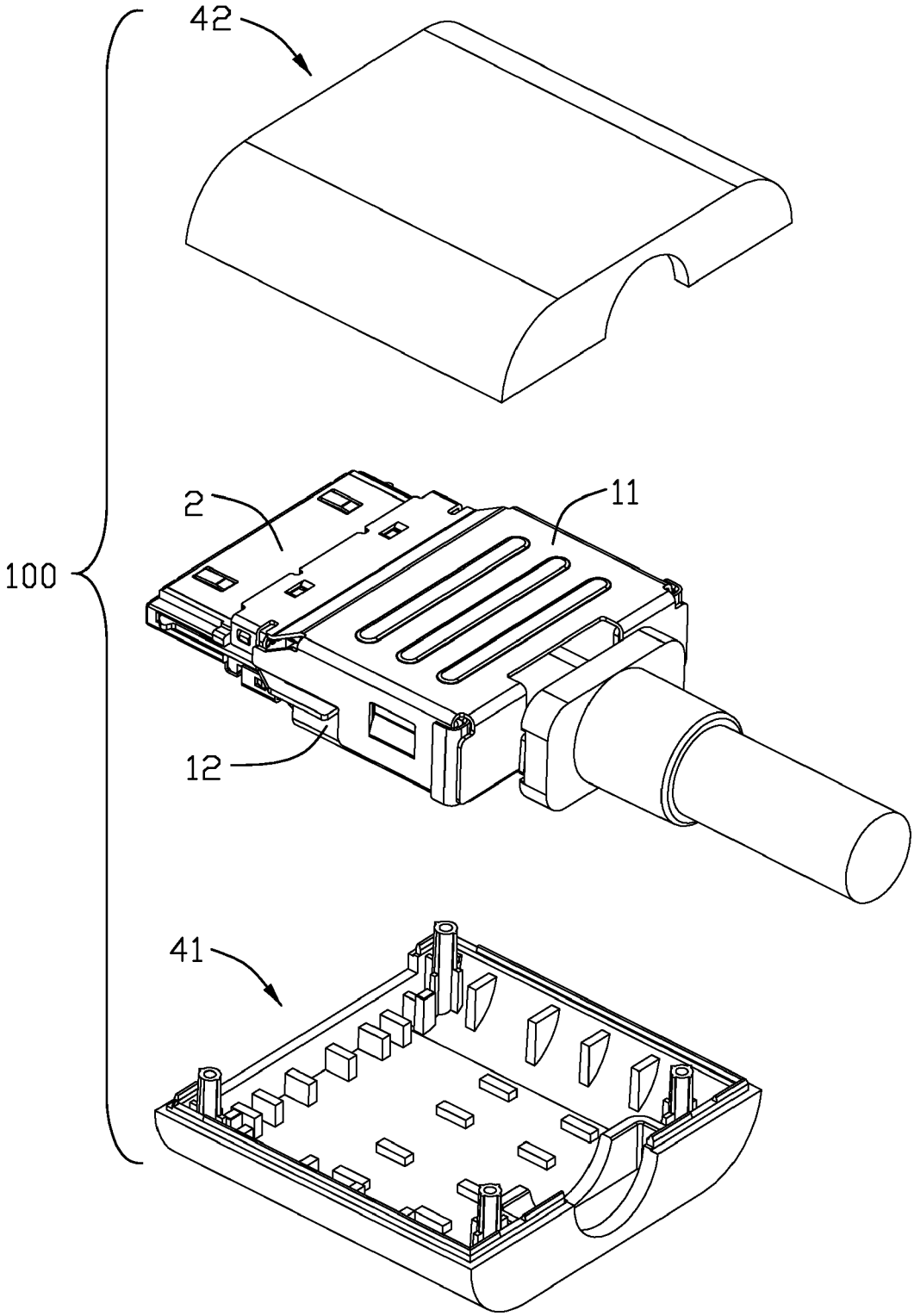
FIG. 7 is a partially assembled view of the cable connector assembly.
Figure 8:
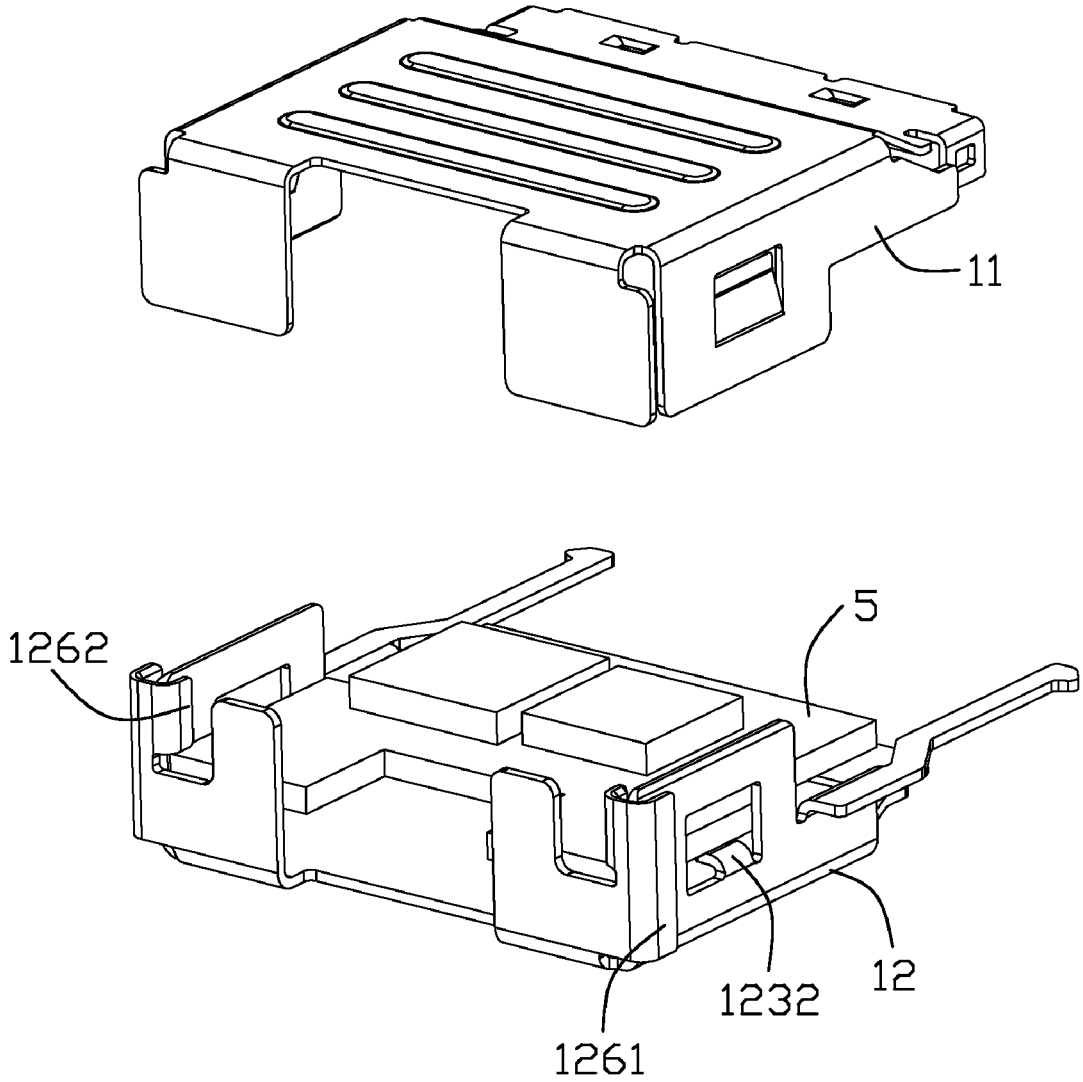
FIG. 8 is an exploded, perspective view of the cable connector assembly shown in FIG. 6.

Referring to FIGS. 2-3 and FIG. 6, the upper shielding member 11 is made of metallic material and includes a base portion 111, a mounting portion 112 extending forwards from a front end of the base portion 111, a pair of side walls 113, 114 extending downwards from lateral sides of the base portion 111, and a rear wall 115 extending downwards from a back end of the base portion 111. The rear wall 115 defines a cutout (not numbered) therein. The mounting portion 112 defines a pair of latching portions 116 extending downwards from lateral sides thereof, and each latching portion 116 has a through hole 1161 therein. The side walls 113, 114 define elastic portions 1131, 1141 respectively. The rear wall 115 is spaced from back end of the side walls 113, 114 to form a pair of slits 117. A pair of protrusions 1121 projecting downwards are defined on the mounting portion 112.

The lower shielding member 12 comprises a base portion 121, a fixing portion 122 extending forwards from a front end of the base portion 121, a pair of side walls 123, 124 extending upwards from lateral sides of the base portion 121, and a rear wall 125 extending upwards from a back end of the base portion 121. The fixing portion 122 has a pair of locking tabs 1221 on both sides thereof. The side walls 123, 124 define a pair of openings 1231, 1241 receiving corresponding elastic portions 1131, 1141 and a pair of arms 1233, 1243 extending forwards. The openings 1231, 1241 define supporting portions 1232, 1242 extending towards an interior side from bottom walls thereof respectively. A pair of U-shaped stopping portions 126 are extended from lateral sides of the rear wall 125, and each stopping portion 126 comprises a first restricting flake 1261 on outer sides of the side walls 123, 124 and a second restricting flake 1262 on inner sides of the side walls 123, 124. The second restricting flake 1262 is shorter than the first restricting flake 1261 along a mating direction, the printed circuit board 5 is received in the receiving space 10 and located on the supporting portions 1232, 1242 and adjacent to bottom surfaces of the second restricting flakes 1262, so to prevent the printed circuit board 5 from moving along a direction perpendicular to the mating direction. When the upper shielding member 11 assembled to the lower shielding member 12, the stopping portions 126 are inserted into the slits 117, and the second restricting flakes 1262 are accommodated in the receiving space 10 with the first restricting flakes 1261 exposed outside the receiving space 10. The rear wall 115 of the upper shielding member 11 is located behind the stopping portions 126, and the elastic portions 1131, 1141 are locked into the corresponding openings 1231, 1241 to prevent the upper shielding member 11 from separating from the lower shielding member 12 along a transverse direction.

The cable assembly 3 comprises a metallic retention member 6, a strain relief member 7 and a cable 8. The metallic retention member 6 includes a ring member 61 enclosing the cable 8 and a pair of wings 62. The strain relief member 7 comprises a pipe 71 and a main portion 72 having a pair of grooves 721 on a front surface thereof, the wings 62 are received in the corresponding grooves 721.

The insulated cover 4 comprises a top cover 41 and a bottom cover 42, the top cover 41 and the bottom cover 42 have a cavity respectively and receiving slots 411, 421 accommodating the main portion 72. The top cover 41 has four posts 412 in corners thereof, and each post 412 defines a positioning hole 4121 therein. The bottom cover 42 defines four standoffs 422 combined with the corresponding positioning holes 4121.

The printed circuit board 5 includes a front segment 51 and a back segment 52 wider than the front segment 51, a cutout (not numbered) is recessed forwardly from a back end of the back segment 52.

Figure 4:
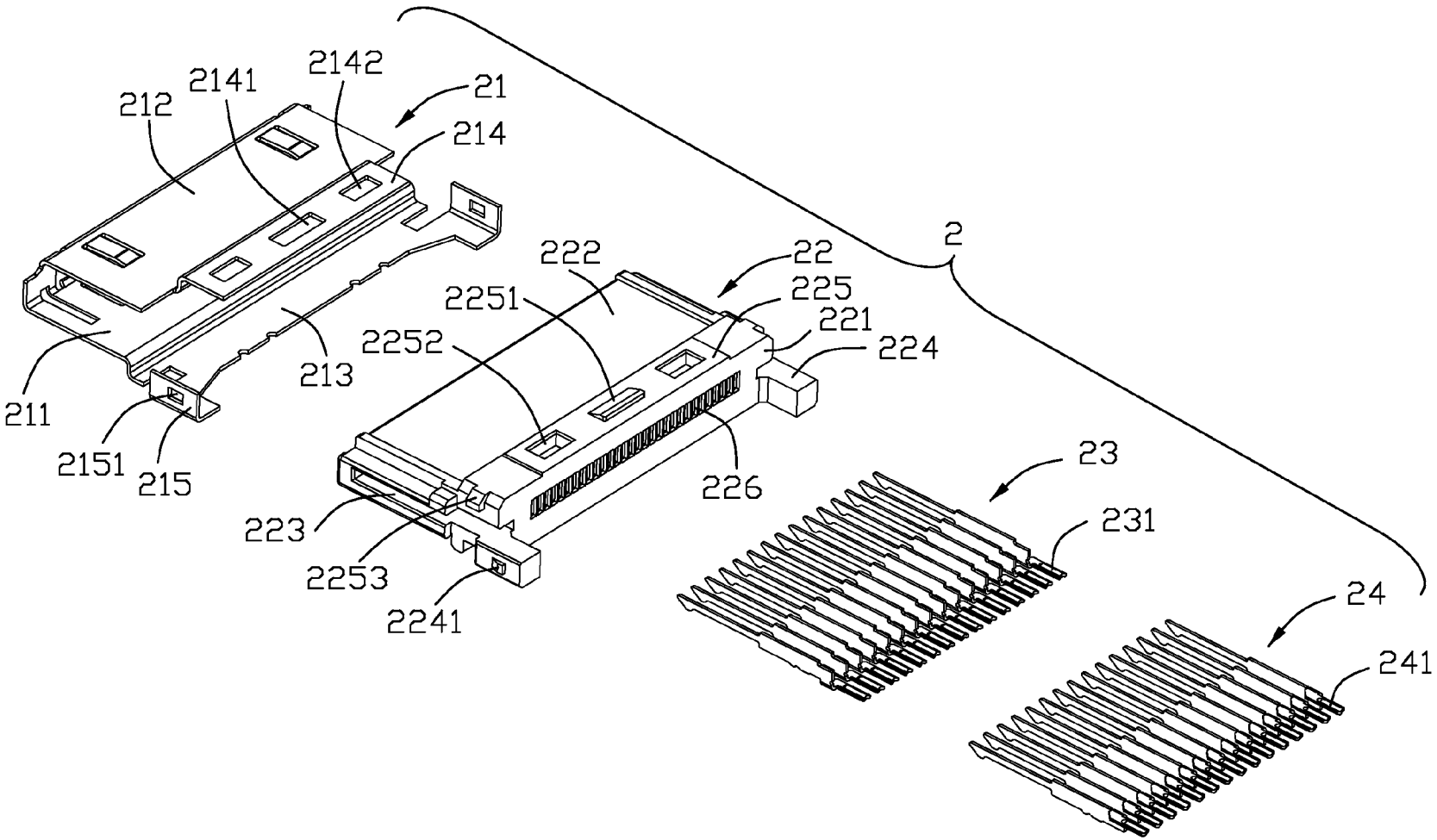
FIG. 4 is a partially exploded, perspective view of the cable connector assembly.
Figure 5:
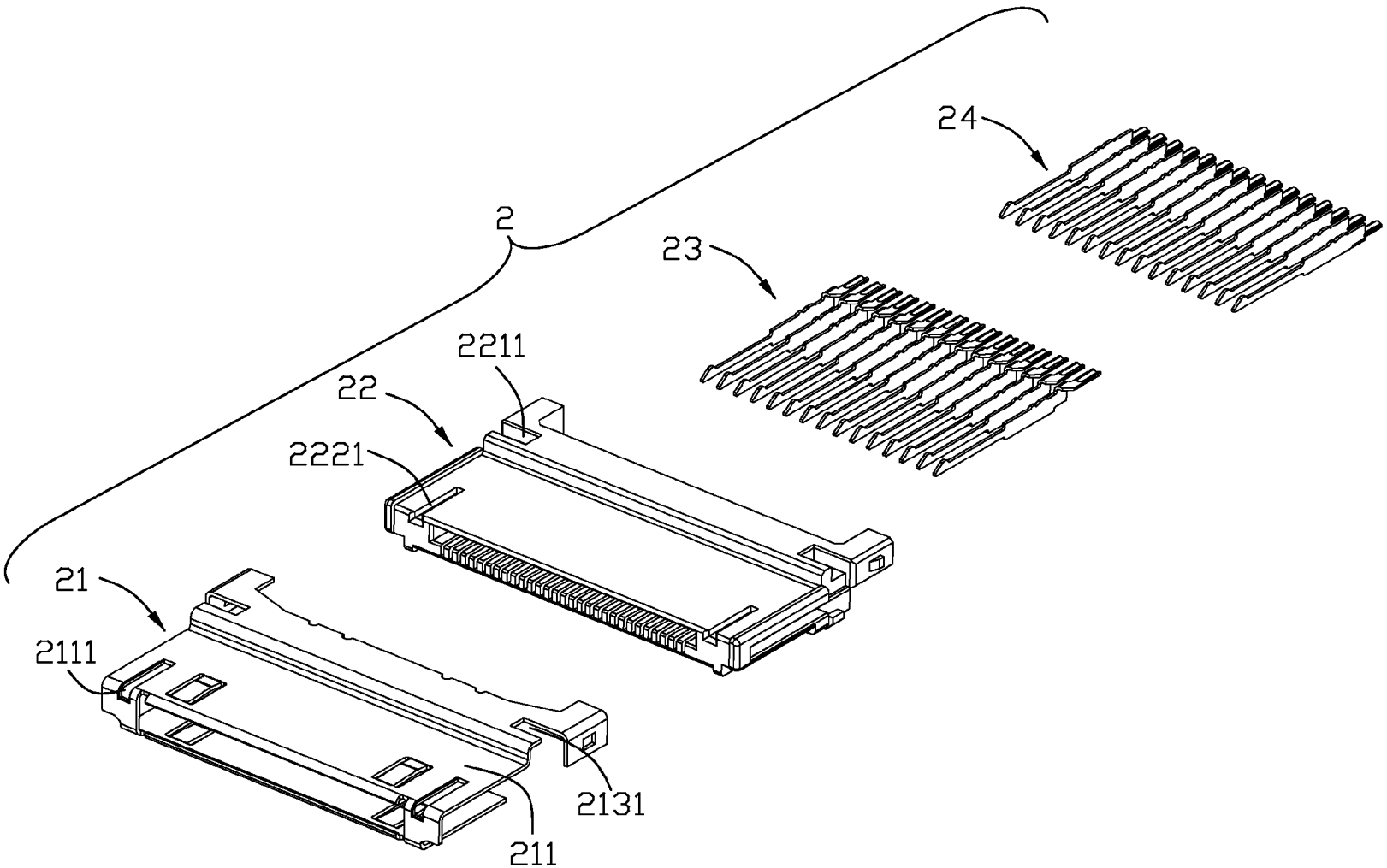
FIG. 5 is similar to FIG. 4, but viewed from another aspect.

Referring to FIGS. 4-5, the connector 2 comprises the metallic shell 21, the insulative housing 22 received in the metallic shell 21, and the group of first and second contacts 23, 24 retained in the insulative housing 22.

The metallic shell 21 includes a first plate 211 and a second plate 212 parallel to the first plate 211, the first plate 211 is extending backwards to form a fixing portion 213, and the second plate 212 is extending backwards to form a locking portion 214. The fixing portion 213 defines a pair of cutouts 2131 at lateral sides thereof and a pair of fastening portion 215 with a through hole 2151, and the locking portion 214 defines a plurality of locking holes 2141, 2142. A pair of hollows 2111 are defined in a front part of the first plate 211.

The insulative housing 22 comprises a basic portion 221 and a tongue portion 222 extending forwards from the basic portion 221, a pair of channels 223 are defined at lateral sides of the insulative housing 22. The basic portion 221 has a pair of projecting portions 224 extending rearwards from a back surface thereof, each projecting portion 224 defines a tab 2241 on an outer side thereof. The basic portion 221 defines a locking mean 225 on an upper surface thereof, the locking mean 225 comprises a protruding portion 2251 and a pair of sunken portions 2252 located on both sides of the protruding portion 2251, and a pair of blocks 2253 are defined on lateral sides of the locking mean 225, the protruding portion 2251 and the sunken portions 2252 are aligning in a line. A plurality of passageways 226 are defined through the insulative housing 22 along the mating direction, the tongue portion 222 defines a pair of depressions 2221 on a bottom surface thereof, and a pair of notches 2211 are defined in a bottom surface of the basic portion 221 on both sides.

When assembling, the connector 2 is assembled firstly, the groups of first contacts 23 and second contacts 24 are arranged spaced from each other and received in corresponding passageways 226 of the insulative housing 22, the metallic shell 21 encloses the insulative housing 22 therein with the first plate 211 and the second plate 212 shielding the tongue portion 222, and the locking portion 214 latches with the locking mean 225, with the protruding portion 2251 inserted into the locking hole 2141, the sunken portions 2252 is aligned with the locking holes 2142, and the hollows 2111 are aligned with the corresponding depressions 2221. The cutouts 2131 are aligned with the notches 2211, the tabs 2241 are protruding into the through holes 2151. After finishing the assembly of the connector 2, the printed circuit board 5 is assembled to the connector 2, tail portions 231 of the first contacts 23 are soldered to a bottom surface of the front segment 51 of the printed circuit board 5, tail portions 241 of the second contacts 24 are soldered to a top surface of the front segment 51, and wires of the cable 8 are soldered to the back segment 52 of the printed circuit board 5. Then, the connector 2 is coupled to the lower shielding member 12, the arms 1233, 1243 inserted into the channels 223 of the insulative housing 22, the locking tabs 1221 are latched with the cutouts 2131 and the notches 2211, the back segment 52 of the printed circuit board 5 is placed on the supporting portions 1232, 1242 and under the second restricting flakes 1262. Then the upper shielding member 11 is coupled to the lower shielding member 12, the second restricting flakes 1262 are accommodated in the receiving space 10, and the through holes 1161 are latched with the blocks 2253, the elastic portions 1131 are inserted into the openings 1231, the protrusions 1121 are inserted into the sunken portions 2252 and the locking holes 2142. The printed circuit board 5 and a back part of the connector 2 are received in the receiving space 10 formed by the upper shielding member 11 and the lower shielding member 12. At last, the insulative cover 4 are enclosing the upper shielding member 11 and the lower shielding member 12, and the main portion 72 is accommodated in the receiving slots 411, 421.

The side walls and the rear walls of the upper shielding member 11 and the lower shielding member 12 are perpendicular to the base portions 111, 121, so can be named vertical walls.

In other alternative embodiment, the upper shielding member 11 may be defined with no rear wall 115, and the stopping portion 126 may be extending from the side wall of the lower shielding member 12. The stopping portion 126 can be defined on the upper shielding member 11 to prevent the upper shielding member 11 from separating from the lower shielding member 12.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an insulative housing and a plurality of contacts received in the insulative housing;

a cable assembly connected with the contacts by a printed circuit board;

an upper shielding member; and a lower shielding member together with the upper shielding member to form a receiving space, each of the upper shielding member and the lower shielding member having a base portion and a plurality of vertical walls extending from the base portion, the lower shielding member defining a stopping portion to prevent the upper shielding member from moving along a transverse direction, the stopping portion being of U-shaped and comprising a first restricting flake and a second restricting flake, and a corresponding vertical wall of the upper shielding member located between the first restricting flake and the second restricting flake.

2. The cable connector assembly as claimed in claim 1, wherein the stopping portion extends from one of the vertical walls of the lower shielding member.

3. The cable connector assembly as claimed in claim 1, wherein a slit is defined between two neighboring vertical walls of the upper shielding member.

4. The cable connector assembly as claimed in claim 3, wherein the stopping portion is inserted into the slit.

5. The cable connector assembly as claimed in claim 4, wherein the first restricting flake is located outside the receiving space, and the second restricting flake is located inside the receiving space.

6. The cable connector assembly as claimed in claim 5, wherein the second restricting flake is shorter than the first restricting flake along a vertical direction.

7. The cable connector assembly as claimed in claim 1, wherein the printed circuit board is received in the receiving space and located below the second restricting flake.

8. The cable connector assembly as claimed in claim 7, wherein the lower shielding member defines a pair of supporting portions on lateral sides, and the printed circuit board is located on the supporting portions.

9. The cable connector assembly as claimed in claim 8, wherein each supporting portion is bent towards an interior side of the lower shielding member.

10. A cable connector assembly, comprising:

an insulative housing with a plurality of contacts received therein;

a cable electrically connected to the contacts;

a metallic shielding member enclosing the insulative housing, the metallic shielding member having a first shielding part and a second shielding part, both the first shielding part and the second shielding part having a base portion, a pair of side walls and a rear wall connected to and perpendicular to the base portion;

a U-shaped engaging portion formed on the rear wall of the first shielding part, with a back edge of the corresponding side wall extending the engaging portion; and a gap formed between the side wall and the rear wall of the second shielding part, with the engaging portion partially received in the gap.

11. The cable connector assembly as claimed in claim 10, wherein the engaging portion comprises a first restricting flake and a second restricting flake located at opposite sides of one of the side wall.

12. The cable connector assembly as claimed in claim 10, wherein each side wall defines a main portion and a arm extending forwards from the main portion.

13. A cable connector assembly comprising:

a connector including an insulative housing enclosed in a metallic shell;

a printed circuit board connected to a rear portion of the connector along a front-to-back direction;

first and second shielding members located by two opposite sides of the printed circuit board in a vertical direction perpendicular to said front-to-back direction, the first shielding member defining a first side wall abutting against a second side wall, which is defined on the second shielding member, in a lateral direction perpendicular to said vertical direction and said front-to-back direction, the first shielding further defining a first rear wall abutting against a second rear wall, which is defined in the second shielding member, in said front-to-back direction; and a lying U-shaped structure formed on said first rear wall of the first shielding member to sandwich both said first side wall and said second side wall in said lateral direction.

14. The cable connector assembly as claimed in claim 13, wherein said first side wall and said second side wall are latched to each other in said vertical direction.

* * * * *